United States Patent [19]

Reed

[11] Patent Number: 5,068,991

[45] Date of Patent: Dec. 3, 1991

[54] GUNSTOCK STORAGE ASSEMBLY

[76] Inventor: Larry N. Reed, HC 72, Box 149, Cookson, Okla. 74427

[21] Appl. No.: 682,269

[22] Filed: Apr. 9, 1991

[51] Int. Cl.[5] ..... F41C 23/22

[52] U.S. Cl. ..... 42/71.01

[58] Field of Search ..... 42/71.01, 72, 73, 74

[56] References Cited

U.S. PATENT DOCUMENTS

| | | | |
|---|---|---|---|
| 746,859 | 12/1903 | Marble | 42/71.01 |
| 856,016 | 6/1907 | Balson | 42/71.01 |
| 1,051,960 | 2/1913 | Kennedy | 42/71.01 |
| 1,266,024 | 5/1918 | Kennedy | 42/71.01 |
| 1,331,074 | 2/1920 | Marble | 42/71.01 |
| 1,485,456 | 3/1924 | Von Frommer | 42/71.01 |
| 4,679,367 | 10/1987 | Brophy | 42/71.01 |

*Primary Examiner*—Michael J. Carone

*Attorney, Agent, or Firm*—Richard C. Litman

[57] ABSTRACT

Choke storage for shotguns is provided by the formation of a piurality of separate elongated chambers within the butt of the shotgun stock with each chamber presenting a snug fit for the removable storage of a choke. A special heel plate affixed to the stock butt is formed with one-half of a sliding male-female interlock and cooperates with the other half of this interlock being carried by a removable outermost butt plate. A simple, twist-lock device retains the butt plate in the fully installed condition wherein the butt plate presents a natural extension of the stock butt. The removable butt plate may include a recoil shoulder pad integral therewith.

11 Claims, 1 Drawing Sheet

14
36
28
44
106
12
64
100
20
16
30
33
38
32
18
24
22
26
44
42
40
34
94
88

44
50
46
54
66
58
16
62
58
43
66
60
48
56
60
44
52

96
46
84
82
94
98
95
103
92
108
88
16
102
72

64
88
86
108
90
74
82
72
84
78
80
68
70
76
90
94
95

GUNSTOCK STORAGE ASSEMBLY

FIELD OF THE INVENTON

This invention relates generally to firearms and more particularly, to an improved storage assembly in a shotgun stock especially adapted to house a collection of chokes.

BACKGROUND OF THE INVENTION

In the sport of shotgunning, it is well recognized that a shooter, with any one shotgun, may frequently require various chokes for the barrel of his firearm. Although many shotgun models are offered with a specific desired choke such as, full or modified, many users prefer to have a shotgun which may be used under various circumstances. For example, a shooter with but one shotgun may wish to use it not only for hunting, such as upland game but also, for trap or skeet shooting and each of which may call for a different choke.

To accommodate such varied use as above, removable chokes are utilized and this introduces the problem by which the present invention offers a solution, namely, the safe, ready and convenient storage of one or more spare chokes. Only by providing this storage within the shotgun itself would one be assured of always having the alternate choke(s) available. In this manner, the shooter does not have to remember to bring along the other chokes such as in a coat pocket and where they obviously could become soiled.

DESCRIPTION OF THE RELATED ART

It is broadly known to provide a storage compartment within the stock of a gun, for the reception of any of various articles. One such example will be found in U.S. Pat. No. 2,484,168 issued to Jachimiec and which illustrates a large chamber opening toward the butt of the stock. A heel plate is pivotally affixed to the butt and allows selective access to the chamber. A somewhat similar example follows in U.S. Pat. No. 3,011,283 issued to Lunn et al. which depicts chambers within a rifle stock for the reception of cleaning tools and which are enclosed by a pivotal plate. Another rifle buttstock having a storage compartment for cleaning tools is shown in U.S. Pat. No. 4,512,101 issued to Waterman, Jr. wherein a butt plate is fastened by means of a bolt therethrough. The concept of providing choke storage means on a shotgun will be seen in U.S. Pat. No. 4,933,316 issued to Litton, Sr. et al. This patent offers choke storage by means of a tubular extension removably affixed to the forward end of the shell magazine. Such an arrangement obviously drastically alters the appearance of the gun and could very well affect the gun balance. Additionally, not all shotguns include a magazine which would permit such modification.

SUMMARY OF THE INVENTION

By the present invention, an improved shotgun choke storage assembly is provided wherein one or more chokes may be stored within individual elongated chambers within the gun shoulder stock. The usual heel plate is replaced by one having a bore aligning with each choke chamber within the stock and a provided with a sliding interlock construction. This interlock cooperates with a mating interlock as carried by a butt plate whereupon the user gains access to the stock chambers by a sliding, planar displacement of the butt plate to achieve its complete separation from the gun. A catch member carried by either the butt plate or heel plate securely retains the butt plate in the use position on the gun stock and is readily manipulated, such as by a spent shell rim, to permit removal of the butt plate from the gun.

Accordingly, one of the objects of the present invention is to provide an improved gunstock assembly for the storage of one or more auxiliary gun devices including a rearwardly directed chamber formed in the shoulder stock and which is closed off by a slidably removable butt plate.

Another object of the present invention is to provide an improved gunstock assembly for the storage of one or more auxiliary gun devices including a chamber in the shoulder stock and accessible through an equal number of openings in a heel plate wherein this plate is formed which lock means mating with lock means on a butt plate that is normally secured to the rear of the stock.

A further object of the present invention is to provide an improved gunstock assembly for the storage of one or more auxiliary gun devices including mating key-like locking means on a slidably removable butt plate and a fixedly mounted heel plate with the latter providing access to one or more chambers within the shoulder stock.

Still another object of the present invention is to provide an improved gunstock assembly for the storage of one or more shotgun chokes including one or more chambers in the gun shoulder stock having a periphery defining a close sliding fit with inserted chokes and with a removable butt plate having locking means slidably interlocking with mating locking means in a fixed heel plate.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figures 1, 2, 3, 4:
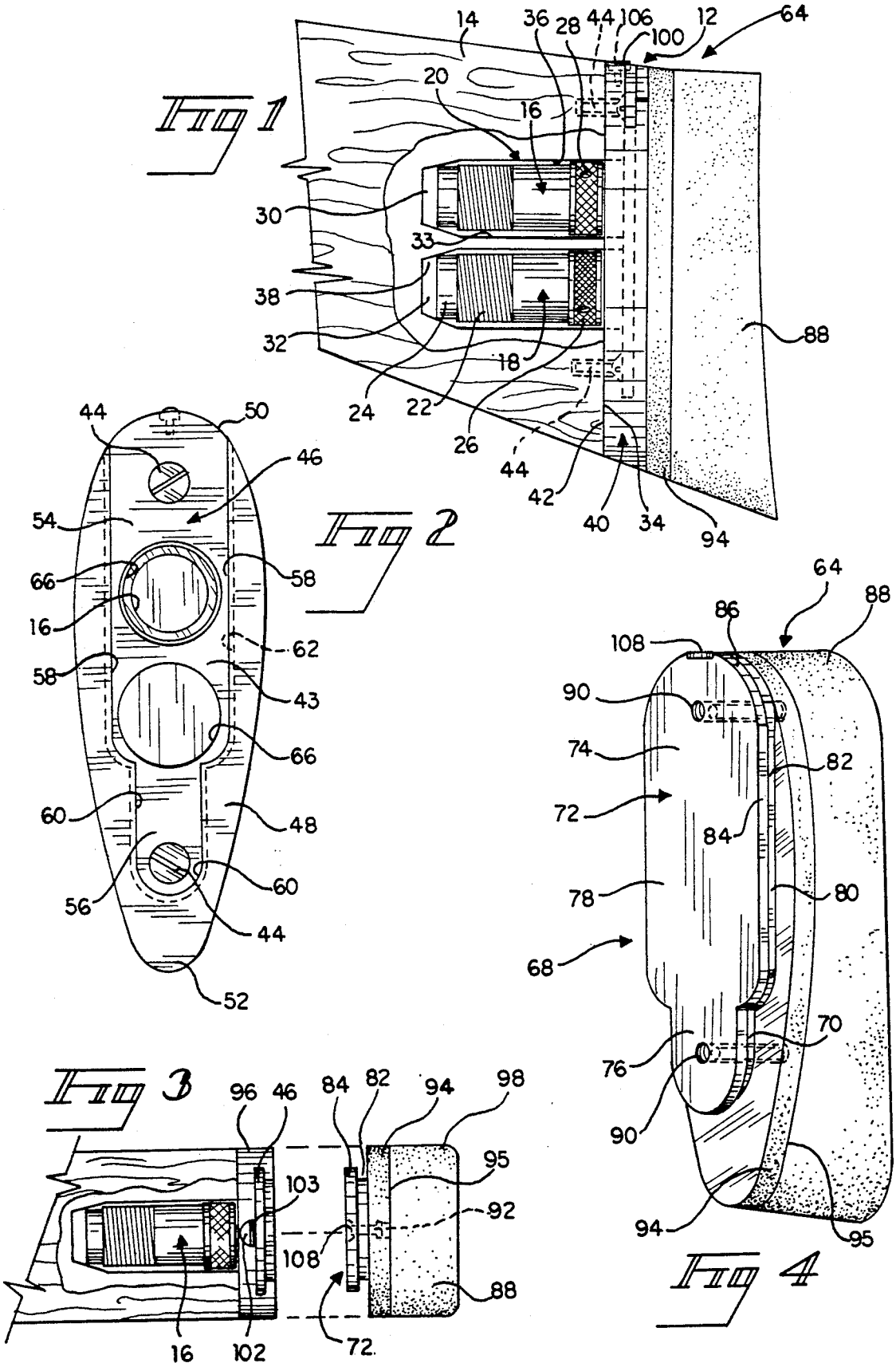
FIG. 1 is a partial side elevation of a shotgun, illustrating the assembly of the invention.
FIG. 2 is an enlarged end elevation of the heel plate of the invention, with the butt plate removed.
FIG. 3 is an exploded top plan view of the assembly of FIG. 1.
FIG. 4 is a side perspective view of the butt plate.

Referring now to the drawings, particularly FIG. 1, the present invention will be understood to relate to a modification for a firearm, particularly a shotgun, and comprises a storage assembly 12 associated with the shoulder stock 14, for one or more chokes 16, 18. As is well known, shotgun chokes comprise a cylindrical body 20 having an externally threaded portion 22 spaced inwardly of a smooth tip 24. The choke 16 or 18 is attached to the muzzle end of the barrel (not shown) by applying a screw motion to an enlarged, knurled front ring 26 which often includes one or more detents 28 for engagement by a wrench or the like.

To accommodate the storage of the choke(s) not being currently used, the stock 14 is provided with a plurality of chambers 30, 32 each defining an elongated cavity having a generally cylindrical wall 33 that opens through the butt or end wall 34 of the stock. The majority of the axial extent of the chamber walls 33 comprises a rear 36 presenting a close sliding fit with the threads and body of the choke while a forward area 38 of the chamber walls will be understood to present a slightly reduced internal diameter presenting an interference fit with the smooth tips 24 of the chokes 16, 18 when fully stored as in FIG. 1 of the drawings.

Affixed to the stock end wall 34 is a heel plate 40 having a front or base wall 42 flushly engaging with the stock end wall 34 and which is attached thereto, as by the fasteners 44, 44. From a review of FIGS. 1–3, the construction of this heel plate 40 will be apparent. Its body is provided with a cut-out 46 extending from a recessed wall 43 and through the rear wall 48 and defines a key opening that is open at the heel plate top 50 and closed at its bottom 52. This key opening 46 includes a wide upper or first segment 54 which communicates with a narrower lower or second segment 56 as shown most clearly in FIG. 2 and the two segments are laterally defined by opposed flanges or lips 58-58, 60-60, respectively. These lips are formed as a result of a continuous undercut channel or groove 62 and combine with the dual-width key opening to provide heel plate interlocking means adapted to cooperate with mating interlocking means soon to be described in connection with a butt plate 64.

With the heel plate 40 affixed to the gun stock 14, free insertion and removal of a choke 16 or 18 from either chamber 30 or 32 is accomplished through the openings 66 formed in the heel plate recessed wall 43 and which are aligned with the rear of the chambers. This manipulation obviously occurs without any impediment when the assembly is as shown in FIG. 2, with the user merely inserting a finger into the bore of the desired choke and pulling it rearwardly. To restrict any rattling or displacement of the choke(s) as stored within the gun stock, the forward area 38 of the chamber walls may be inwardly tapered so that a slight wedge action occurs with the tip 24 of the chokes. Alternatively, various forms of cushion material such as elastomeric rings (not shown), may be disposed within the chambers to resiliently engage and stabilize the stored chokes.

Normally, the storage assembly 12 will appear as in FIG. 1 and wherein the choke chambers 16, 18 are fully masked from view by means of the rear most butt plate 64. The butt plate is adapted for quick and effortless separation from the heal plate 40 and interfaces therewith by means of a planar mounting plate 68. This plate 68 includes a rearwardly directed base wall 70 from which projects a tongue or key member 72 comprising a wide first or upper segment 74 joined to a narrower second or lower segment 76. The forward surface 78 of the key member 72 will be seen from FIGS. 3 and 4 to be spaced from the base wall 70 by the undercut section 80 such that a peripheral groove 82 separates the resultant flange 84 from the base wall 70 except along the top wall 86. The key member 72 and its subjacent groove 82 will be understood to form butt plate interlocking means which cooperates with the heel plate interlocking means aforedescribed to maintain the components assembled as in FIG. 1.

The construction of the butt plate 64 includes a suitable rearmost shoulder piece, such as the illustrated recoil pad 88. This latter member may comprise any desired well known construction. The disclosed pad 88 will be understood to comprise a body of resilient material and may include various passages or bores as is known, in order to increase its compressibility and thus, its shock absorbing ability. Tapped bores 90 in the base wall 70 of the mounting plate 68 readily admit of the attachment of the pad 88 by means of fasteners 92. These fasteners may be disposed through countersunk bores (not shown) in the pad 88 but a more positive lamination of the components of the butt plate 64 is achieved by initially passing the fasteners through a rigid, planar adaptor plate 94. In this manner, the integrity of the recoil pad 88 is maintained as the pad may then be adhesively secured to the outer face 95 of the adaptor plate 94.

With the above construction in mind, the operation of the storage assembly 12 may now be described. When in the normal use condition as in FIG. 1, the butt plate 64 is securely locked juxtaposed the heel plate 40 with the assembly 12 providing a rigid extension of the gun stock 14. The unitary effect of the assembly of the components with the gun stock is further carried out by the formation of the periphery 96 of the heel plate 40 as well as the periphery 98 of the butt plate 64, such that a smooth, continuous exterior surface exists between these elements.

The positive joining of the butt plate 64 to the heel plate 40 is accomplished due to the cooperation of the mating interlocking means of these two members. It will be understood that the butt plate is affixed by lowering its key member 72 into the key opening 46 of the heel plate 40 with the peripheral flange 84 sliding into the peripheral groove 62 in the heel plate 40. The planar parallel movement of the butt plate is continued until the lower, narrower tongue segment 76 is seated within the lower, narrower segment 56 of the heel plate key opening, at which point the components appear as in FIG. 1. It will be appreciated that a close sliding fit will exist between the male interlocking element as defined by the heel plate flange 84 and the female interlocking element as represented by the heel plate groove 62 such that in effect, no free play is present.

The butt plate 64 is retained in this assembled position by actuation of releasable catch means such as the illustrated threaded member 100 carried by the top 50 of the heel plate 40 and having an uppermost head 102. With the head comprising an asymmetrical member having a slot 103 as shown in FIG. 3, it will be seen that the butt plate 64 will be slidably removable from the heel plate 40 when the catch member head 102 is rotated to the position clear of the top of the key opening 46. Thereafter, when the components are assembled as in FIG. 1, twisting of the threaded catch head 102 will be understood to cause the offset head to rotate and overlie the top 86 of the butt plate mounting plate 68. By including respective recesses on the heel and butt plates, such as the semi-circular recesses 106, 108, the catch head 102 will remain flush with the surrounding structure and thus insure a smooth continuity of the stock periphery. The rigidity of the secured elements is assured by tightening of the threaded catch head 102 to bias the butt plate male interlocking means into engagement within the heel plate female interlocking means.

Access to any choke as stored within the stock 14 is quickly accomplished merely by untwisting of the catch head as by use of a thin coin or the rim of a spent shotgun shell within the slotted head 102. With the head clear of the vertical plane of the butt plate top 86, the shooter may slidably separate the butt plate from the balance of the gun to permit removal or insertion of a choke 16 and/or 18.

From the foregoing description it will be appreciated that an improved shotgun choke storage assembly is provided which allows ready access to chokes stored in the butt of the shoulder stock, through the separation of a butt plate having unique interlocking means cooperating with mating means carried by a heel plate affixed to the butt of the stock.

It is to be understood that the present invention is not limited to the sole embodiment described above, but encompasses any and all embodiments within the scope of the appended claims.

I claim:

1. In a shotgun having a shoulder stock provided with a rear most end wall, the improvement comprising;

a chamber extending forwardly from said end wall for the storage of a shotgun accessory within said shoulder stock, first substantially vertically extending interlocking means fixed relative said stock end wall, a separable butt plate having second substantially vertically extending interlocking means attached thereto, said first and second interlocking means engageable with one another upon a parallel sliding displacement therebetween to attach said butt plate to said stock end wall to cover said chamber, and catch means manipulatable to maintain said butt plate attached to said stock and prevent unintentional separation therebetween.

2. A shotgun according to claim 1 wherein, said first vertically extending interlocking means includes a heel plate having a planar key opening therein.

3. A shotgun according to claim 1 wherein, said second vertically extending interlocking means includes a planar key member connected to said butt plate.

4. A shotgun according to claim 1 including;

a plurality of said chambers in said shoulder stock.

5. A shotgun according to claim 1 wherein, said chamber is bounded by a substantially circular wall having means adapted to snugly receive a shotgun choke.

6. A shotgun according to claim 1 wherein, said butt plate includes a recoil pad of resilient composition fixed relative said second vertically extending interlocking means.

7. A shotgun according to claim 1 including, a heel plate attached to said stock end wall and having said first interlocking means thereon, and said catch means including a fastener carried by said heel plate and having an asymmetrical head shiftable to overlie said second interlocking means when engaged within said first interlocking means.

8. A shotgun according to claim 2 wherein, said key opening includes a wide segment adjacent a narrow segment.

9. A shotgun according to claim 2 wherein, said key opening is bounded by a flange defining an adjacent undercut groove and said second interlocking means includes a key member having a peripheral flange closely mating within said groove.

10. A shotgun according to claim 3 wherein, said key member includes a wide segment adjacent a narrow segment.

11. A shotgun according to claim 3 wherein, said key member includes a peripheral flange spaced forwardly of said heel plate and said first interlocking means includes a key opening bounded by a peripheral groove closely mating with said flange.

* * * * *